US006698164B2

(12) United States Patent
Trani et al.

(10) Patent No.: US 6,698,164 B2
(45) Date of Patent: Mar. 2, 2004

(54) METHOD FOR PRODUCING CONTAINERS FROM A FILM OF HEAT-SEALABLE FLEXIBLE MATERIAL

(75) Inventors: Giorgio Trani, Venice (IT); Marion Sterner, Venice (IT)

(73) Assignee: BP Europack S.p.A., Lugo di Vicenza (IT)

( * ) Notice: Subject to any disclaimer, the term of this patent is extended or adjusted under 35 U.S.C. 154(b) by 0 days.

(21) Appl. No.: 09/877,676

(22) Filed: Jun. 8, 2001

(65) Prior Publication Data

US 2002/0193223 A1 Dec. 19, 2002

(51) Int. Cl.[7] ..... B65B 9/00

(52) U.S. Cl. ..... 53/451; 53/370.6; 53/202; 53/450; 53/459; 53/567; 53/568

(58) Field of Search ..... 53/451, 370.6, 53/202, 450, 459, 567, 568

(56) References Cited

U.S. PATENT DOCUMENTS

| | | | | |
|---|---|---|---|---|
| 3,581,457 A | * | 6/1971 | Gerlach et al. | 53/450 |
| 3,659,775 A | | 5/1972 | Truman | |
| 4,079,662 A | * | 3/1978 | Puccetti et al. | 53/552 |
| 5,570,569 A | * | 11/1996 | Masuda | 53/410 |
| 5,806,284 A | * | 9/1998 | Gifford | 53/435 |
| 5,832,698 A | * | 11/1998 | Huguenin | 53/451 |

FOREIGN PATENT DOCUMENTS

| | | |
|---|---|---|
| FR | 1 130 714 | 2/1957 |
| GB | 966 708 | 8/1964 |
| WO | 00 07903 | 2/2000 |
| WO | 01 25111 | 4/2001 |

* cited by examiner

*Primary Examiner*—Rinaldi I. Rada
*Assistant Examiner*—Brian Nash
(74) *Attorney, Agent, or Firm*—Kudirka & Jobse, LLP

(57) ABSTRACT

The method entails unwinding portion of film stored in roll form. The film is made of a heat-sealable single- or multi-layer flexible material. The flaps for the unwound portion are folded until they are side by side or overlapped along a narrow band. The resulting new lateral edges are folded further so as to form longitudinal accordion-like portions and the bottom is then formed with a transverse heat-sealed portion which is produced simultaneously with a median cut relative to the heat-sealed portion, successively separating two pairs of adjacent containers. The heat-sealed bottom is inserted into the container by an extent which is equal to half the width of the lateral accordion-like portion and a longitudinal heat-sealed portion is then produced in the region where the flaps lie side by side and/or overlap, blocking the bottom and the accordion-like portion, simultaneously with a complete or partial cutting of the longitudinal heat-sealed portion.

4 Claims, 6 Drawing Sheets

METHOD FOR PRODUCING CONTAINERS FROM A FILM OF HEAT-SEALABLE FLEXIBLE MATERIAL

CROSS-REFERENCE TO RELATED APPLICATIONS

The disclosure of Italian Application Serial No. PD2000A000013 filed Jan. 24, 2000 is incorporated herein by reference.

BACKGROUND OF THE INVENTION

The present invention relates to a method for producing containers particularly suitable for containing liquids or viscous or granular fluids by using a film of heat-sealable flexible material.

Containers produced by means of a single- or multilayer film of flexible material and suitable to contain liquids, such as beverages or viscous fluids of various kinds, particularly foodstuffs, are known.

These packages are produced by folding and heat-sealing, along predefined lines and operating sequences, a sheet of heat-sealable flexible film unwound from a roll.

The problems of these containers are connected to the use of flexible film, which in itself does not give shape stability to the container when the latter is filled with a liquid product which also does not have a shape of its own.

This problems affects production processes, which have to obtain structures which are as much as possible locally strengthened or stable so that the container changes as little as possible when an equally shapeless liquid or granular product is introduced.

According to known methods, various kinds of container have been devised in which the local stiffenings and reinforcements are obtained through production processes which entail starting from films in which multiple heat-sealed folds have already been prepared before the use of said films for production of the container.

It is thus possible to obtain ribs which are located in chosen points and allow to strengthen the resulting container.

This method is not convenient, since it entails preparing rolls which already have overlap regions, and this entails much larger volumes for such rolls.

Moreover, these rolls can only allow to obtain containers of a certain type, shape and size, since the stiffening overlaps cannot be located randomly in the container.

SUMMARY OF THE INVENTION

The aim of the present invention is to eliminate the drawbacks of the known art, providing a method which allows to obtain a container having a predefined shape which substantially cannot be modified by the filling product.

Within this aim, an object is to provide a method which starts from a film which is not necessarily prepared beforehand with reinforced regions.

Another object is to provide a method which allows to use conventional machines and systems, albeit with appropriate modifications to the fixtures that are used.

This aim and these and other objects which will become better apparent hereinafter are achieved by a method for producing containers from a film of heat-sealable flexible material, characterized in that it comprises the following steps:

a) unwinding from a roll a portion of film made of heat-sealable flexible material;

b) folding the film, arranging flaps of the film side by side, possibly with an overlap thereof;

c) tucking in folded lateral edges of the film so as to form longitudinal accordion-like portions;

d) providing a transverse heat-sealed portion so as to form a bottom, blocking the accordion-like portions and simultaneously cutting said heat-sealed portion in a median region thereof;

e) inserting the heat-sealed bottom by an extent which is equal to half a width of the accordion-like portion;

f) providing a longitudinal heat-sealed portion in a region where the flaps lie side by side and/or overlap, blocking the bottom and the accordion-like portion and simultaneously cutting the longitudinal heat-sealed portion in a median region thereof.

BRIEF DESCRIPTION OF THE DRAWINGS

Further characteristics and advantages of the invention will become better apparent from the detailed description of some preferred embodiments, given by way of non-limitative example and illustrated in the accompanying figures, wherein.

DESCRIPTION OF THE PREFERRED EMBODIMENTS

Figure 1:
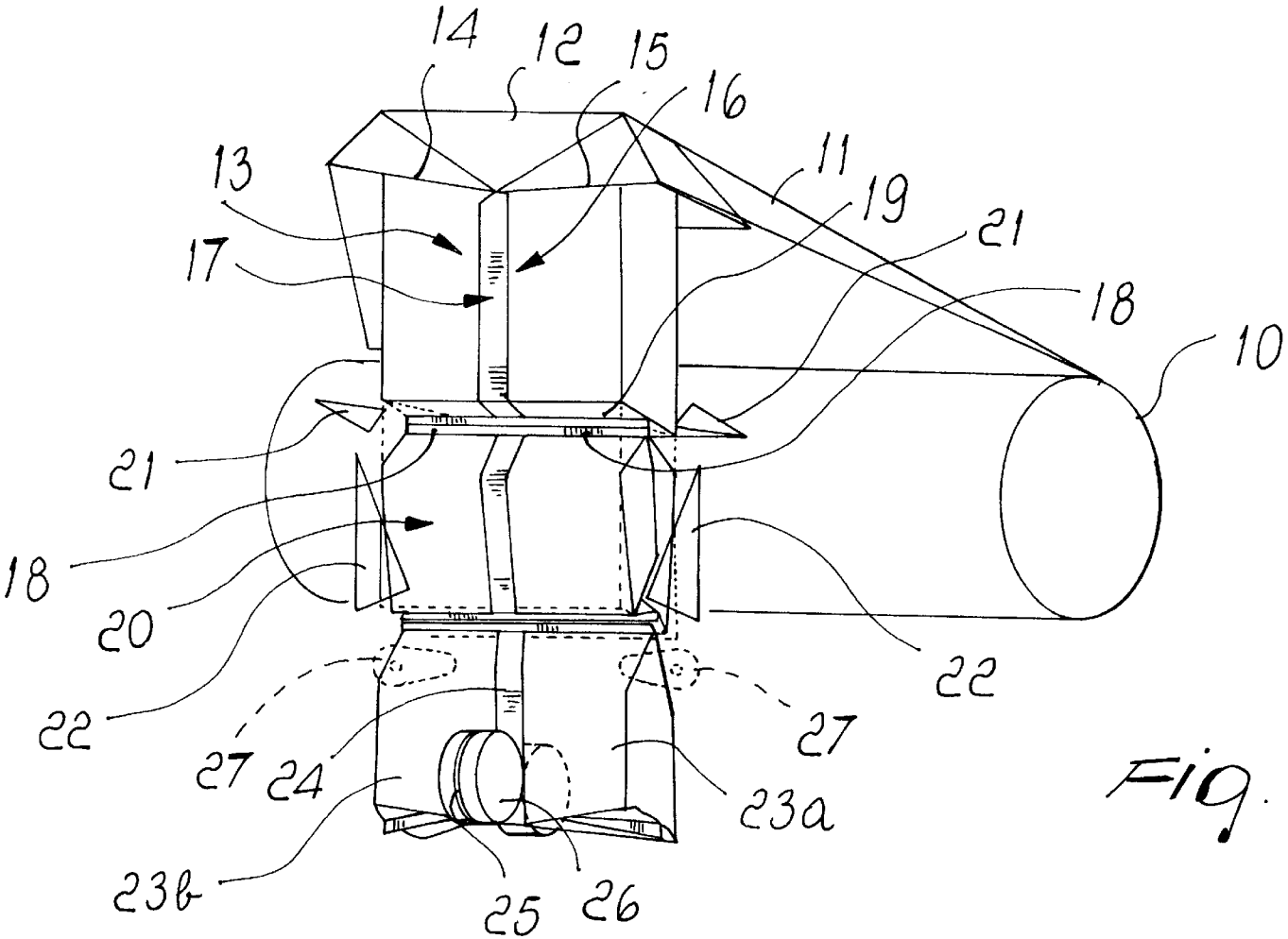
FIG. 1 is a schematic view of the steps of a first embodiment of the method.

With reference to the figures, FIG. 1 illustrates a first embodiment of the method according to the invention, in which a film 11 of flexible and heat-sealable material is unwound stepwise from a roll 10.

The film passes through a forming collar 12 of an ordinary vertical forming machine, thus obtaining a tube 13 which has a rectangular cross-section and in which flaps 14 and 15 of the film 11 are made to overlap in a median region along a longitudinal band 16 on which a longitudinal heat-sealed portion 17 is provided which consolidates the tubular shape.

The central heat-sealed portion 17 is twice as wide as necessary, since, as described hereinafter, it is designed to obtain two containers arranged side by side.

The tube 13 can be formed, with particular machines, even without the presence of the forming collar 12, so that in the first step of the method a tube with a central longitudinal heat-sealed portion 17 is formed in any case.

After this step, a transverse heat-sealed portion 18 is formed, producing a bottom 19 of the container which, simultaneously with this operation, is filled from above with a liquid or in any case with a product to be packaged.

Also this heat-sealed portion 18 is twice as wide, since it also serves to close the upper part of the already-filled container 20 which had been formed before and filled during the continuous production step of the machine.

During the heat-sealing of the transverse portion 18, a transverse cut is also performed which separates the filled and closed container 20 from the one that will be formed subsequently.

By means of pushers 21, the bottom 19 of the container is pushed upward and lateral guides 22 push the sides of said container inward.

In a subsequent step, the container, now designated by the reference numerals 23*a* and 23*b*, is provided with a further central heat-sealed portion 24 which overlaps the existing heat-sealed portion 17 and forms two independent containers, which are also separated by a rotating blade 25 arranged in a median region of a heat-sealing roller 26.

Additional eccentric pushers 27 further help the insertion of the side of the container toward the inside of said container.

Figures 2, 3:
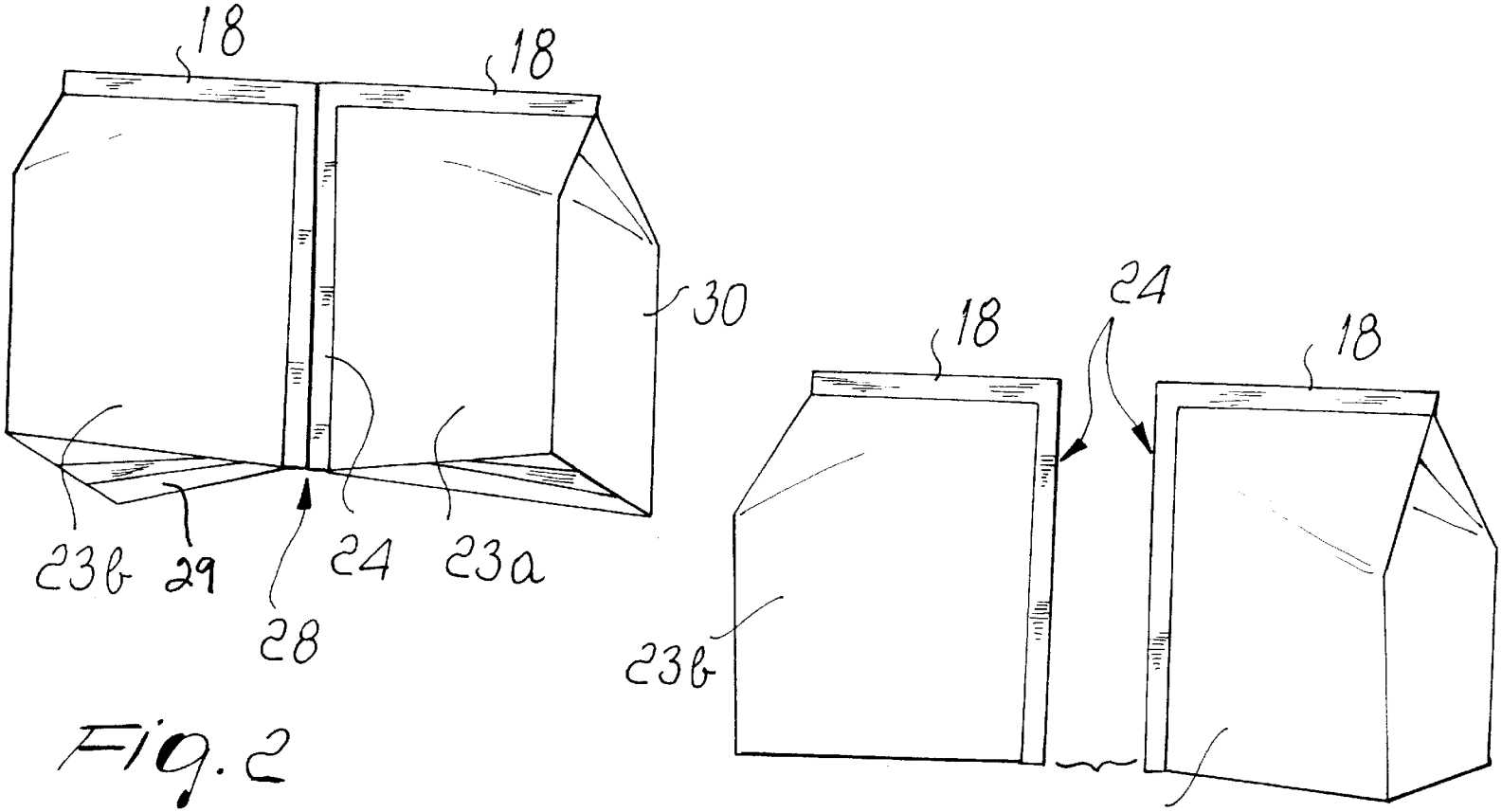
FIG. 2 is a perspective view of the pair of containers obtained by the method according to FIG. 1.
FIG. 3 is a perspective view of the individual containers of FIG. 2, shown separated from each other.

The median cut, designated by the reference numeral 28 in FIG. 2, can be performed continuously, achieving complete separation of the two containers, as shown in FIG. 3.

As an alternative, the cut 28 can be made as a line of small perforations or by means of a laser cut, which allows to keep the two containers 23*a* and 23*b* coupled to each other, although they can be easily separated at the time of use or sale.

The resulting container, as shown in FIG. 2, has two opposite faces which are directly heat-sealed by means of the heat-sealed portions 18 and 24 and has two other faces, i.e., the bottom now designated by the reference numeral 29 and the side designated by the reference numeral 30, which have an accordion-like shape which gives volume to said container.

Figure 4:
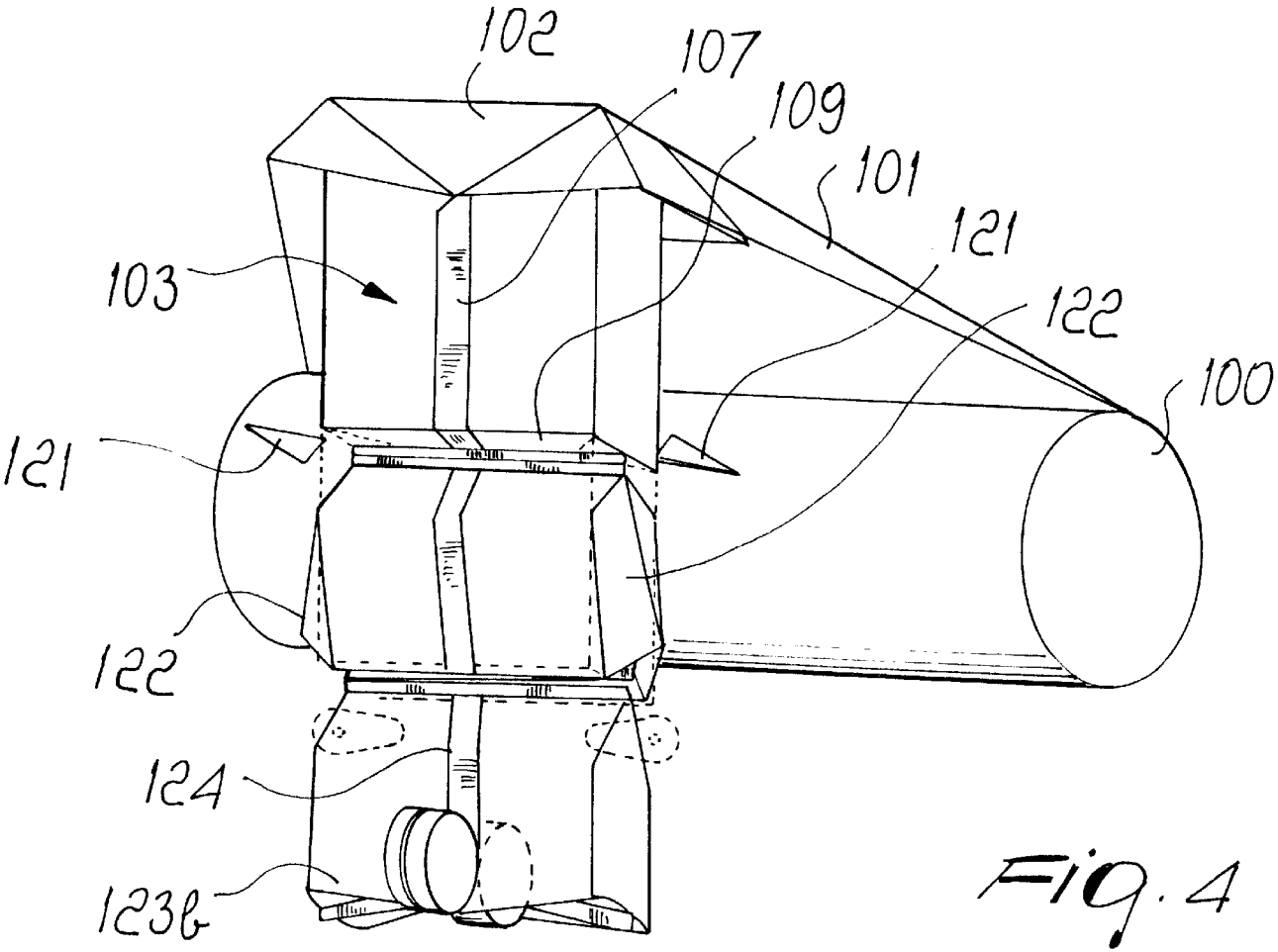
FIG. 4 is a perspective view of a second embodiment of the method according to the invention.

FIG. 4 illustrates another embodiment of the production of containers of the type shown in FIGS. 2 and 3.

In this case, a film 101 is unwound from a roll 100 and passes through a forming collar 102 to form a tube 103 which is again blocked in the median region by a heat-sealed portion 107.

In this case, the embodiment entails that blade means 121 push the bottom 109 upward while the sides, now designated by the reference numeral 122, are pushed together and folded outward.

Then, as disclosed above, a double-width median heat-sealed portion with an intermediate cut is provided, forming two individual containers 123*a* and 123*b* which are fully similar to the ones shown in FIGS. 2 and 3.

The two embodiments of the method described so far relate to vertical packaging machines in which filling with the product is performed directly in the machine during the forming of the container.

Figure 5:
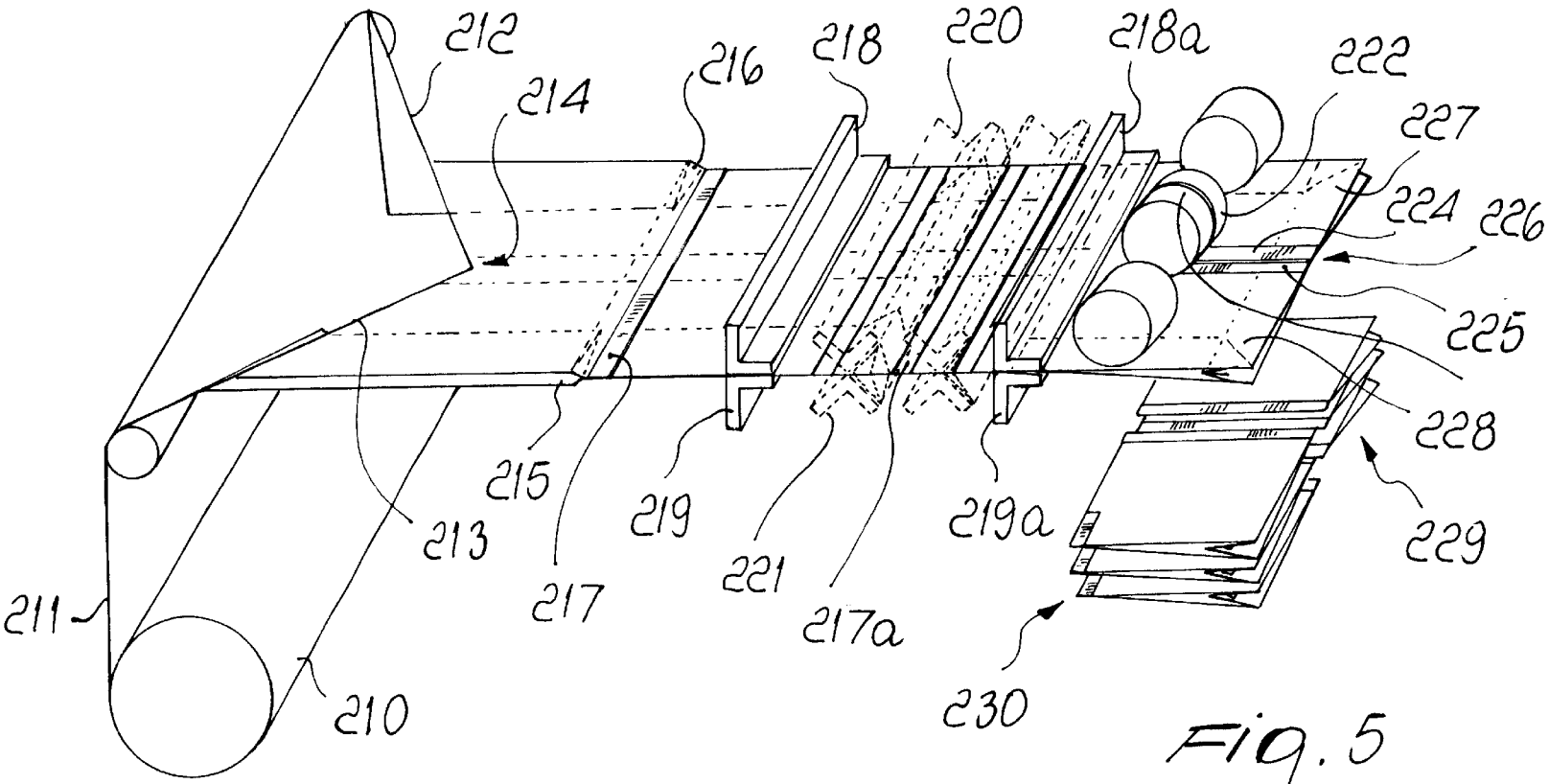
FIG. 5 is a perspective view of a third embodiment of the method according to the invention.
Figure 6:
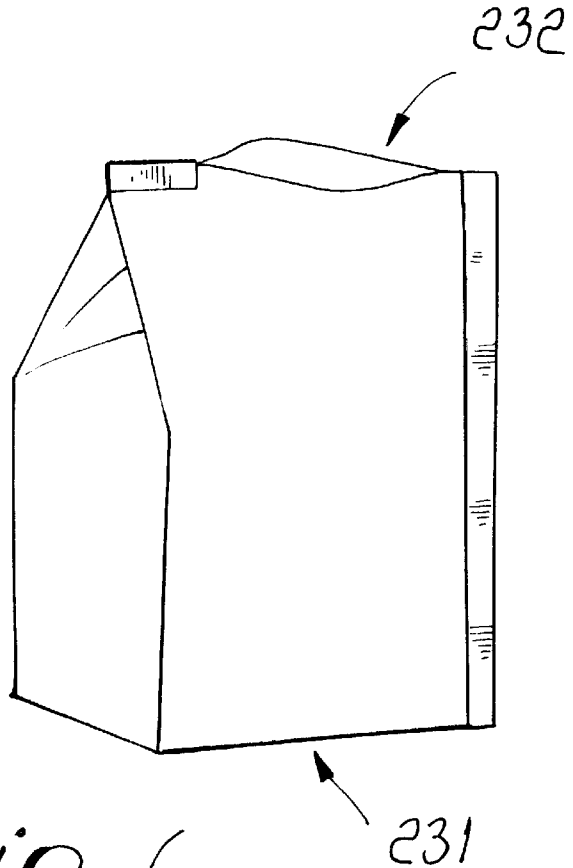
FIG. 6 is a perspective view of the container obtained with the method of FIG. 5, shown ready for filling.

FIGS. 4, 5 and 6 illustrate applications of the same process on horizontal machines which prepare the containers which are then filled in other steps and at different times.

With reference to FIG. 5, a film 211 is unwound stepwise from a roll 210 and is folded so that two lateral flaps 212 and 213 of the film lie side by side in a median region 214.

The side-by-side arrangement might also be an overlap, although this is not necessary.

At the same time, two internal accordion-like portions, designated by the reference numerals 215 and 216 respectively, are formed laterally by folding the film itself.

This operation occurs horizontally, in the illustrated case, and advancement occurs practically continuously.

After these first operations, a transverse heat-sealed portion 217 is provided, forming the bottoms of the container.

In a subsequent step, bars, designated by the reference numerals 218 and 219 respectively and arranged in direct contact with the container that is being formed, by means of suction holes, not shown, and of a system which generates vacuum, take the two faces of the film and move it away, for example by rotation, as shown schematically by 220 and 221.

The central heat-sealed portion, now designated by the reference numeral 217*a*, is kept motionless, or moved backward, while the container being formed advances.

In this manner, the bottom that is being formed is inserted in the container and when insertion is completed the bars, now designated by the reference numerals 218*a* and 219*a*, reposition the faces of the container so that they are mutually adjacent again while the bottom is comprised between them.

In this situation, a pair of heat-sealing rollers 222 and 223 forms a double longitudinal heat-sealed portion 224 and 225 and an intermediate cut 226 which separates the two side-by-side containers, which are now designated by the reference numerals 227 and 228; the containers are collected in separate stacks 229 and 230 and are ready for subsequent filling.

As an alternative to the opening system that uses suction bars, it is possible to use systems based on jets of compressed air.

Figure 7:
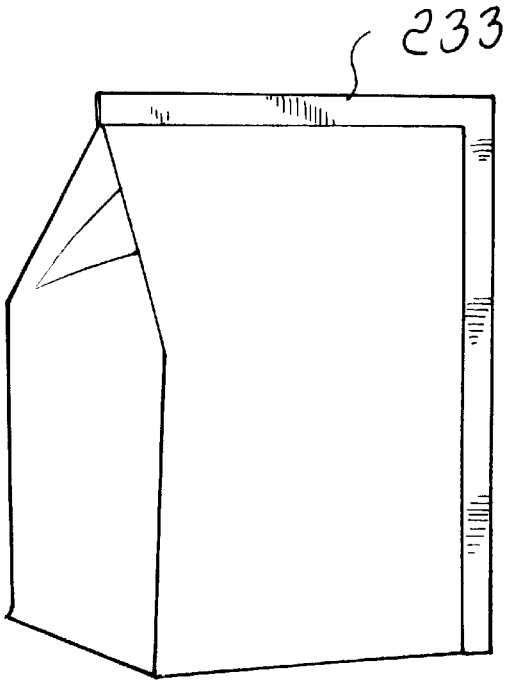
FIG. 7 is a perspective view of the container of FIG. 6, shown permanently closed.

The resulting containers are of the type shown in FIGS. 6 and 7.

As clearly shown in particular in FIG. 6, the container has a substantially triangular accordion-like bottom 231, while on the opposite side, which is the upper side used for filling, a mouth 232 is left open in order to allow to insert the product.

A heat-sealing station is then provided in the filling machine, after the product has been introduced, which produces an upper heat-sealed portion 233 which permanently closes the container.

Figure 8:
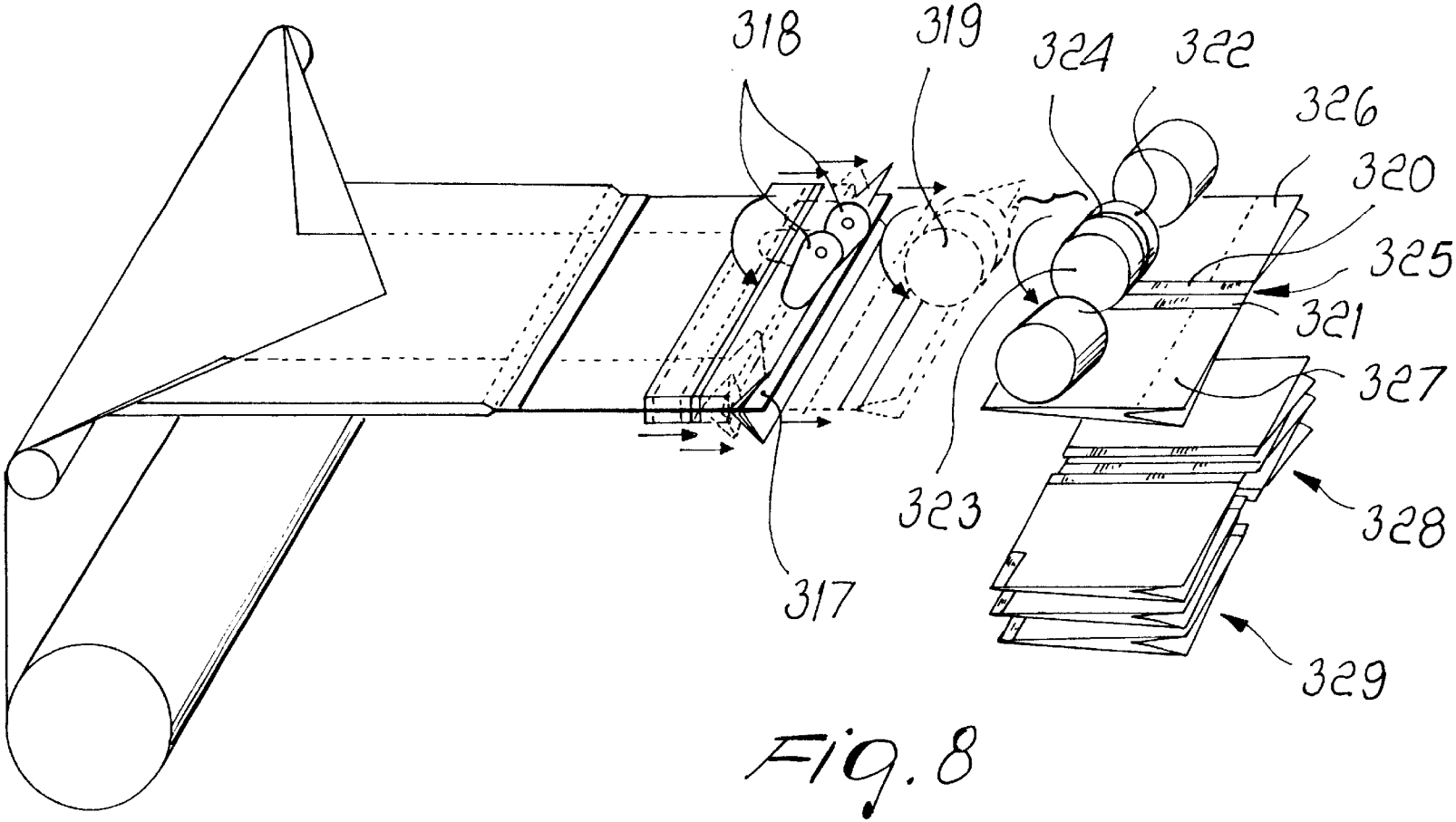
FIG. 8 is a perspective view of a fourth embodiment of the method according to the invention.

FIG. 8 illustrates another embodiment of the method shown in FIG. 5; the variation is introduced in the intermediate step, in which the bottom obtained by means of a transverse heat-sealed portion 317 is inserted between the folded flaps of the sheet during the advancement of said folded sheet by virtue of eccentric blade means designated by the reference numeral 318.

Wheels, one of which is designated by the reference numeral 319, then flatten the resulting accordion-like portion, so as to be able to provide a double longitudinal heat-seal 320 and 321 by means of heat-sealing wheels 322 and 323, while a central rotating blade 324 produces a median cut 325 which separates the two containers, now designated by the reference numerals 326 and 327, which are collected in two stacks 328 and 329.

The containers thus obtained can be stored while waiting to be filled, or else they can pass directly to a carousel which opens their upper part, which has not yet been heat-sealed yet, and carries them to a filling machine and to a final heat-sealing operation for closure.

In all of the illustrated cases, the film can be already prepared with weakened and pre-perforated regions for the insertion of a straw which can also be inserted again and removed, when necessary, from a weakened or peel-off region of a heat-sealed portion.

It is also possible to apply caps or equivalent closures in any point.

Even in the variations of the basic process, the cut that separates the containers can be complete or partial, so that two containers remain joined and can be subsequently divided by the user who has purchased them as a pair or at the time of sale.

From what has been described and illustrated, it is evident that the aim and all the intended objects of the invention have been achieved, and in particular that a method has been devised which allows to obtain a container whose shape is sufficiently definite and stable even after filling thanks to the effect of two heat-sealed sides and of two accordion-like sides.

All this, because of the characteristics of the method, is performed without having to start from film in roll form which is already prepared with overlaps or strengthened regions and without requiring additional strengthening means.

The method is therefore simple to perform with equipped machines which do not modify the general structure of already-known machines.

This allows very inexpensive and fast production.

What is claimed is:

1. A method for producing containers from a film of heat-sealable flexible material, comprising the following operating steps:

A. unwinding from a roll a portion of film made of heat-sealable flexible material;

B. folding the film, arranging flaps of the film side by side, possibly with an overlap thereof;

C. tucking in lateral edges of the film that have formed so as to produce longitudinal accordion-like portions;

D. providing a transverse first heat-sealed portion so as to form a bottom, blocking the accordion-like portions and simultaneously cutting said heat-sealed portion in a median region thereof;

E. pushing the heat-sealed bottom by an extent which is equal to half a width of the accordion-like portion;

F. providing a longitudinal median heat-sealed portion in a region where the flaps lie side by side or overlap, blocking the bottom and the accordion-like portion and simultaneously cutting the longitudinal heat-sealed portion in a median region;

wherein the film is folded by a collar of a vertical machine while the product is being introduced in the container in said machine;

wherein the bottom is inserted in the container while the lateral accordion-like portions are moved outward by mechanical means of said machine.

2. A method for producing containers from a film of heat-sealable flexible material, comprising the following operating steps:

a) unwinding from a roll a portion of film made of heat-sealable flexible material;

b) folding the film, arranging flaps of the film side by side, possibly with an overlap thereof;

c) tucking in lateral edges of the film that have formed so as to produce longitudinal accordion-like portions;

d) providing a transverse first heat-sealed portion so as to form a bottom, blocking the accordion-like portions and simultaneously cuffing said heat-sealed portion in a median region thereof;

e) pushing the heat-sealed bottom by an extent which is equal to half a width of the accordion-like portion;

f) providing a longitudinal median heat-sealed portion in a region where the flaps lie side by side or overlap, blocking the bottom and the accordion-like portion and simultaneously cutting the longitudinal heat-sealed portion in a median region;

wherein the bottom, obtained with a transverse heat-seal, is inserted between two adjacent faces that will form the container when said faces are temporarily moved mutually apart by means of suction bars.

3. The method according to claim 2, wherein the bottom is inserted while keeping motionless, or retracting, the transverse heat-sealed portion and causing an advancement of the container being formed.

4. The method according to claim 2, wherein the bottom obtained by heat-sealing is inserted in the container being formed by means of rotating and/or translating mechanical means.

* * * * *